US005497724A

United States Patent [19]

Brown et al.

[11] Patent Number: 5,497,724

[45] Date of Patent: Mar. 12, 1996

[54] AFT SEATING

[75] Inventors: Charles N. Brown, Mims; Ronald M. Berman, Merritt Island, both of Fla.

[73] Assignee: Ray Industries, Inc., Knoxville, Tenn.

[21] Appl. No.: 336,790

[22] Filed: Nov. 9, 1994

Related U.S. Application Data

[63] Continuation of Ser. No. 302,591, Sep. 8, 1994, abandoned.

[51] Int. Cl.[6] ..... B63B 17/00

[52] U.S. Cl. ..... 114/343; 114/363

[58] Field of Search ..... 114/343, 363, 114/364; 297/14, 334

[56] References Cited

U.S. PATENT DOCUMENTS 4,567,845 2/1986 Smith ..... 114/363

4,926,783 5/1990 Lathers ..... 114/343

FOREIGN PATENT DOCUMENTS 47789 3/1985 Japan ..... 114/363

*Primary Examiner*—Jesus D. Sotelo

*Attorney, Agent, or Firm*—Malin, Haley, DiMaggio & Crosby

[57] ABSTRACT

The present invention provides an improved aft seating combination including a double bench seat, high/low single person seat and a partial sunpad. The present invention provides for three separate seating configurations. The first configuration provides for a partial, one person sunpad, a single seat on the port side and a double bench seat on the starboard side. The second configuration provides for a full, two person sunpad and a double bench seat on the starboard side. The third configuration provides for a partial, one person sunpad, a double bench seat on the starboard side and a dedicated ingress and egress area having a step.

20 Claims, 8 Drawing Sheets

AFT SEATING

BACKGROUND OF THE INVENTION

This application is a continuation of U.S. application Ser. No. 08/302,591, filed Sep. 8, 1994, now abandoned.

FIELD OF THE INVENTION

The present invention relates generally to boats and in more particular to a novel aft seating for a boat.

DESCRIPTION OF THE PRIOR ART

Conventional aft seating on boats have been in either one of two forms. In the first version the motor box, which is centered, has two jump seats whose pads can be moved up to create a sunpad on either side of the motor box. In the second version a full sunpad makes an engine hatch all the way across the width of the interior of the cockpit, and a bench seat is in front of the sunpad.

With the motor box version with the two high/low jump seats, one could remove the jump seats and walk to the back of the boat. However, with the bench seat version and full sunpad, one was only capable of walking to the bench seat. Thus, prior art use of bench seats and full sunpads have prevented a person from walking to the back of the boat.

When leaving and/or entering the interior of the high/low version of the boat, the person has to step on the cushion, which doesn't provide a stable support when used as a step. This could possibly cause a person to be thrown into the boat or even out of the boat. Thus, indicating the need for a more efficient retention and support system.

Furthermore, boats incorporating the full sunpad version, typically only come in bucket style seats. That's all they can accommodate because they have a full bench seat across the back. These boats don't have room for back-to-back seats which can be converted into loungers or sunpads.

Other examples of boat seating include U.S. Pat. Nos. 3,376,587, 4,567,845, 4,854,261 and 4,945,853. U.S. Pat. No. 3,376,587 issued to Staron discloses a folding seat and locker arrangement for a boat hull. A seat is provided immediately forward of the bailing well of a powerboat and is so mounted that it may be secured in any of three position: horizontally to provide a seat; vertically downward to provide a cover for the compartment beneath the bailing well; or substantially vertically upward to provide easy access to the compartment.

U.S. Pat. No. 4,567,845 issued to Smith discloses a pleasure boat having a conventional cockpit with seats along the opposite sides of the cockpit. The floor of the cockpit has a socket therein for supporting an elevated pedestal seat. The side seats are swingable upwardly toward each other to form an elevated platform for the pedestal seat.

U.S. Pat. No. 4,854,261 issued to Goldsmith discloses a combination seat for boats which includes a housing comprising lower and upper housing sections, a seating assembly mounted on the upper housing section and a galley assembly mounted in the lower housing section. The galley assembly includes a sink, a water supply tank, a water dispenser pump and a thermally insulated container member. The seating assembly is adapted to be moved between an erected position wherein it defines a pair of back-to-back seats and a collapsed portion wherein it defines a substantially flat sleeping platform. The upper housing section and the seating assembly are upwardly hingeable to provide access to the galley assembly.

U.S. Pat. No. 4,945,853 issued to Lathers relates to a recreational boat swivel seat. Lathers discloses a marine vehicle comprising a deck and an L-shaped seat including a seat back member. The seat back member includes a first portion, a second portion generally perpendicular to the first portion and means mounting the seat on the deck for pivotal movement about a generally vertical axis and between a first position, wherein the first portion faces the fore, and second position, wherein the second portion faces aft. The mounting means includes a first generally horizontal plate supported by the deck and having an upper surface, and a second generally horizontal plate supported by the upper surface of the first plate and having an upper surface supporting the L-shaped seat. The seat faces forwardly for use as a front passenger seat and faces rearwardly for entertaining in the aft seating area.

Thus, what is needed in the art is an improved aft seating arrangement which will provide a full sunpad with a bench seat in front of it, while at the same time providing sufficient room for various types of seating. It is also needed in the art an improved aft seating arrangement which can provide a full sunpad with a bench seat in front of it while also providing relatively safe enter/exit for the boaters. What is also needed in the art is an improved aft seating arrangement which provides, for various sitting configurations, improved storage area and superior aft vessel designs. It is, therefore, to the effective resolution of the aforementioned problems and shortcomings that the present invention is directed.

SUMMARY OF THE INVENTION

The present invention provides an improved aft seating combination including a double bench seat, high/low single person seat and a partial sunpad. The present invention provides for three separate seating configurations. The first configuration provides for a partial, one person sunpad, a single seat on the port side and a double bench seat on the starboard side. The second configuration provides for a full, two person sunpad and a double bench seat on the starboard side. The third configuration provides for a partial, one person sunpad, a double bench seat on the starboard side and a dedicated ingress and egress area having a step.

The present invention utilizes a molded fiberglass seat base, motor box and step that is able to provide ample storage under the bench seat section as well as create a large storage area in the engine compartment.

Accordingly, it is an object of the present invention to provide an improved boat aft seating which encompasses the versatility of a high/low seating arrangement with the spaciousness of a bench seat/sunpad.

It is another object of the present invention to eliminate the problems of ingress and egress to the boat's interior.

It is another object of the present invention to turn a traditional limited aft seating arrangement into a multi-functional entertainment area.

It is even still another object of the present invention to provide a very safe way for a boater to get in and out of the boat without disturbing component parts.

It is yet another object of the present invention to provide an improved aft seating which allows a boater to have an automatic sunpad version whether he or she uses the jump seat or not, to complete the sunpad, with a bench seat in front of the sunpad.

In accordance with these and other objects which will become apparent hereinafter, the instant invention will now be described with particular reference to the accompanying drawings.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein.

DESCRIPTION OF THE PREFERRED EMBODIMENTS

Figure 1:
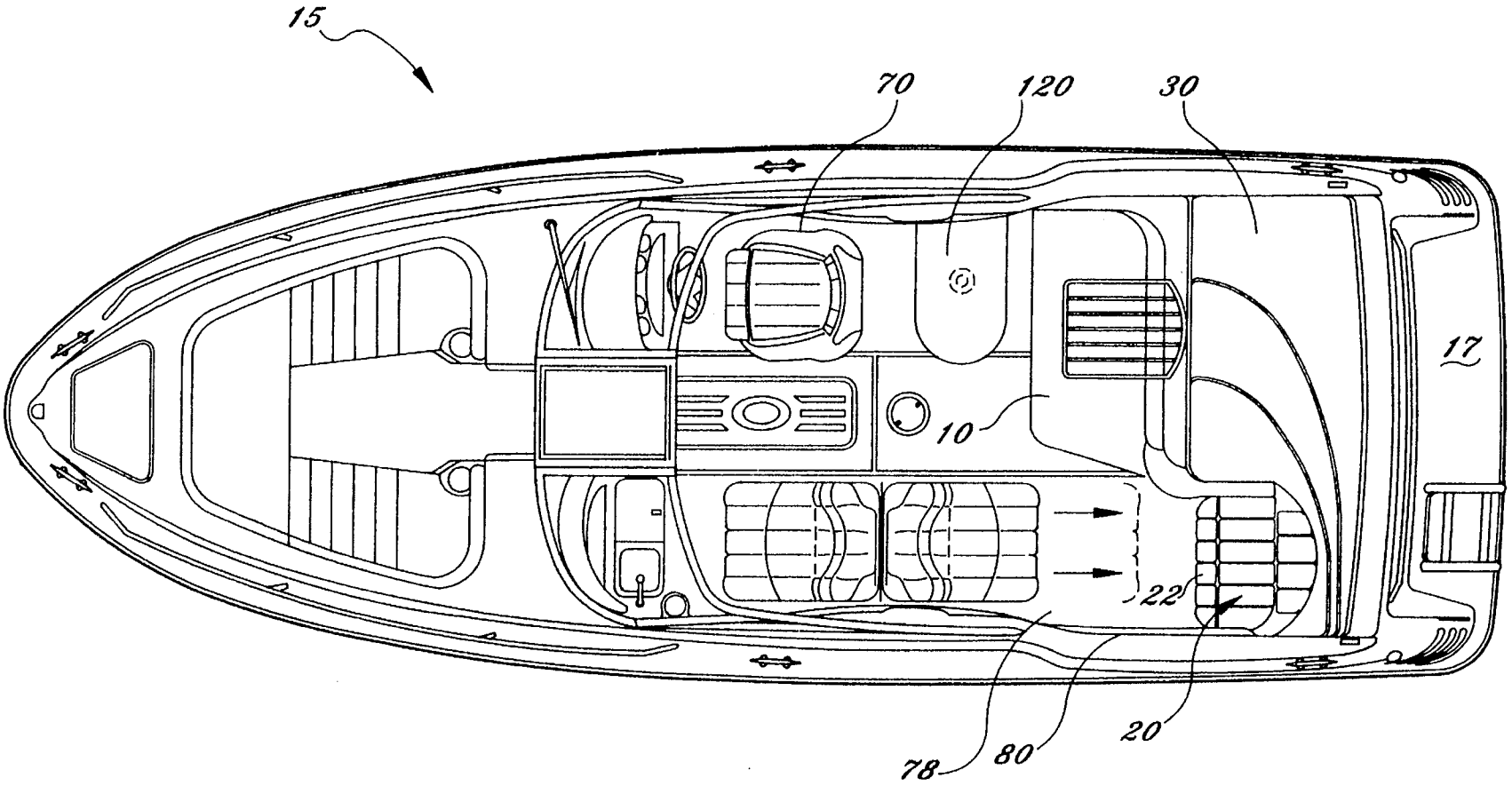
FIG. 1 is a top plan view of the present invention.

As seen in the drawings, a double bench seat 10, high/low single person seat 20 and a partial sunpad 30 are shown disposed to provide a unique combination seating arrangement, storage unit and aft vessel design. High/low seating 20 is a small, single-person seat which is located to port and starboard of the motor box. Seat 20 is capable of being pulled from a seating version and then converted into a sunpad version by bringing a cushion portion 22 of seat 20 up to the top and inserting it into a fixture which holds the seat into place. Thus, the high/low seating in a low position is a seat 20 and in a high position, in conjunction with the partial sunpad 30, creates a full two-person sunpad 40.

Thus, when the single person seat 20 (hereinafter referred to as a "jump seat") is in the high position a full, two person sunpad 40 is created. When the jump seat is in the low position a partial, one person sunpad 30 is still provided. When the seat portion of the jump seat is removed (FIG. 4) a boat interior egress/ingress area 50 is created which preferably contains step 52 to aid in entering and exiting the boat interior.

Thus, a partial sunpad 30 is provided that not only has a double bench seat 10 involved with it, but also had a single seat 20 to the port side which can be used in conjunction with sunpad 30 and bench seat 10. Upon lifting cushion portion 22 up to its filler position, a double sunpad 40 is created which also has a bench seat 10 in front of it which you could also sit in or have a couple laying in back of it.

Preferably, in all embodiments the bench seat 10 encompasses approximately 3/4 of the width of a boat 15. The seat or cushion portion 22 of the jump seat 20 is removable to convert a jump seat 20 when the seat portion 22 is in a low position to a portion of an upper sunpad 40 when the seat portion 22 is in a high position without taking away from the ability to still have a double bench seat 10 in front of it. The present invention allows a boater to walk all the way to the back of boat 15 on the port side to access a swim platform 17 more easily, while still providing a double bench seat 10 across approximately three quarters of the width of boat 15, as well as the ability to have a larger, two person sunpad 40.

Figure 2:
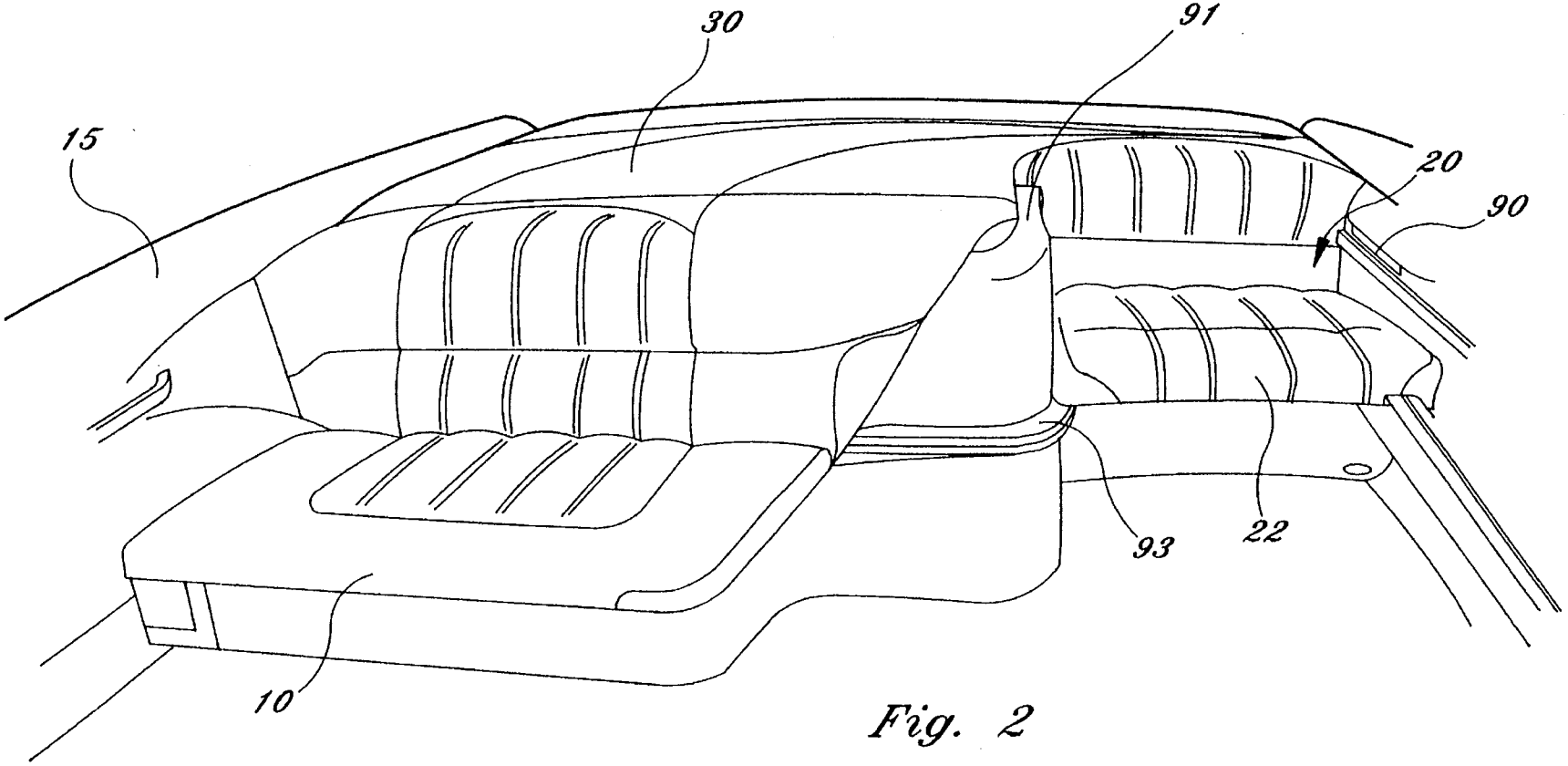
FIG. 2 is a perspective view of the present invention with the cushion portion of a jump seat in a low position.
Figure 3:
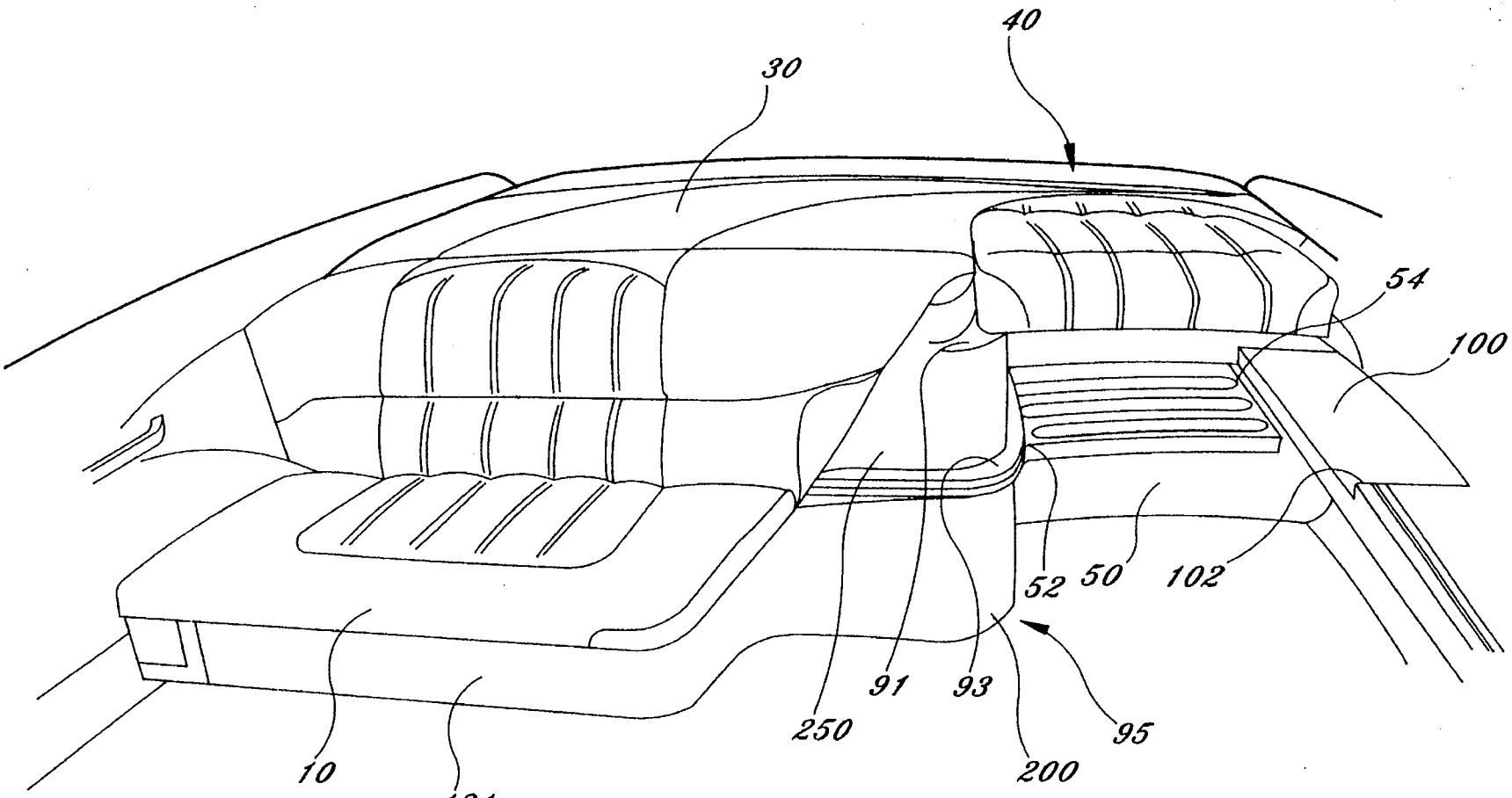
FIG. 3 is a perspective view of the present invention with the cushion portion of a jump seat in a high position.
Figure 4:
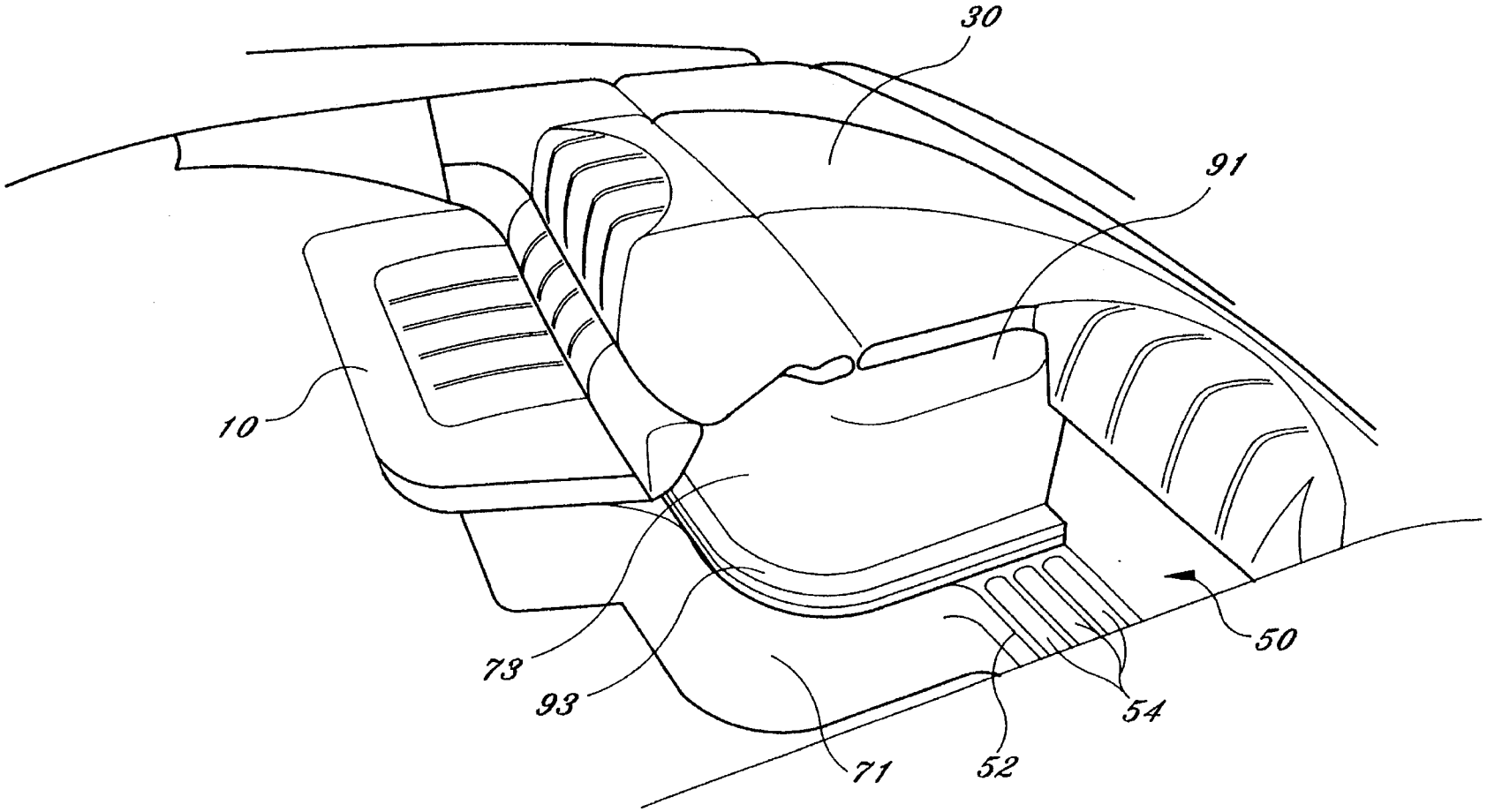
FIG. 4 is a perspective view of the present invention with the cushion portion of a jump seat removed.
Figure 5:
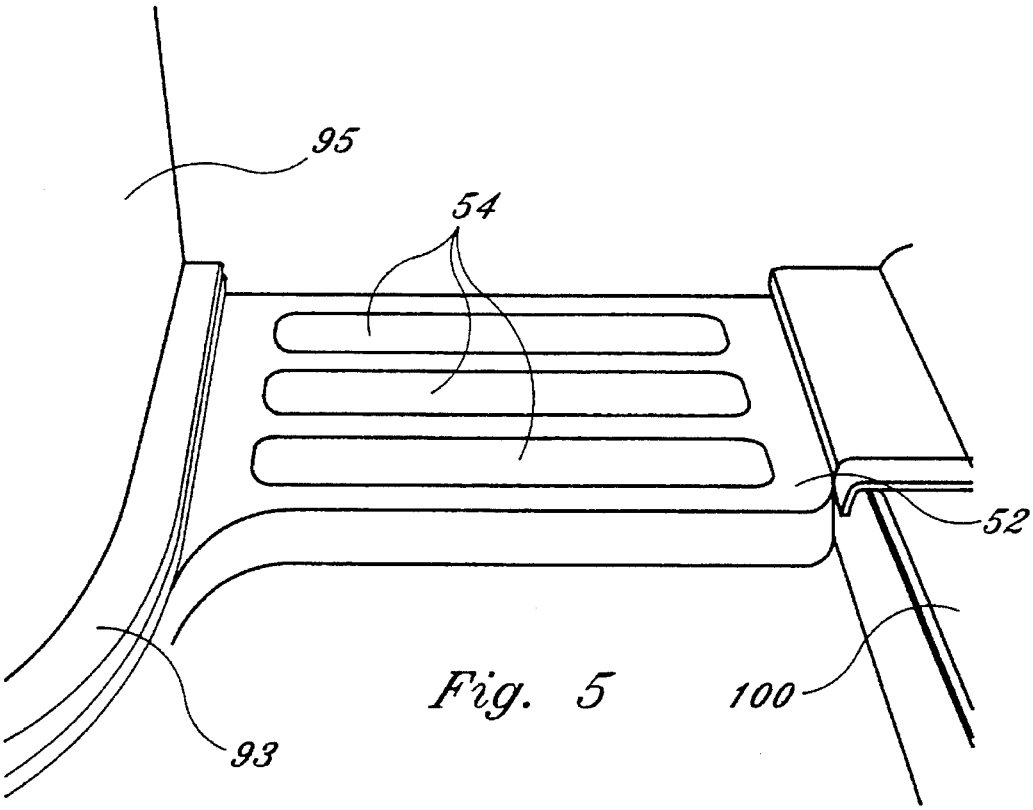
FIG. 5 is a perspective view of the ingress/egress area of the present invention.

FIG. 2 illustrates the partial sunpad 30 for a single person, the double bench seat 10 and the jump seat 20 to the port side of boat 15. FIG. 3 illustrates double sunpad 40 to accommodate two people, side-by-side, with the double bench seat 10 in front of it. FIG. 4 illustrates the partial sunpad 30 sized for one person, the double bench seat 10, plus an integrated step 52 for ingress and egress from boat 15, and which will allow the boat owner to save his or her upholstery by having a dedicated step in that area.

The step 52 is an existing fiberglass part constructed integral with a lower half assembly 200. The seat or cushion portion 22 of the jump seat 20 is stored on top of the dedicated step 52 when used as a single seat 20. Preferably, step 50 will have a non-skid surface or treads 54 disposed on the surface of step 50.

As seen in FIG. 1, the present invention allows for a back-to-back lounger seat 60, as well as a bucket seat 70 for the driver. Accordingly, the novel aft seating arrangement of the present invention has a direct effect upon the passenger and operator seating, as well as the forward seating in the cockpit area. As the port side is provided with a single jump seat 20, extra area is provided to put a back-to-back seat 60. The back-to-back seat 60 can be extended or folded down approximately to the point designated 80 in FIG. 1 and converted into a single person sunpad. When extended, the folded down sunpad is approximately at the same vertical level as the aft jump seat in its low position. Thus, the present invention accommodates the back-to-back seat 60 for conversion or, if its upright, it allows this area 82 for movement of the boaters. As the bench seat 10 only extends along three quarters of the width of the boat, the back-to-back seat 60 is provided with sufficient room to extend and convert into a lounger or sunpad.

Figure 6:
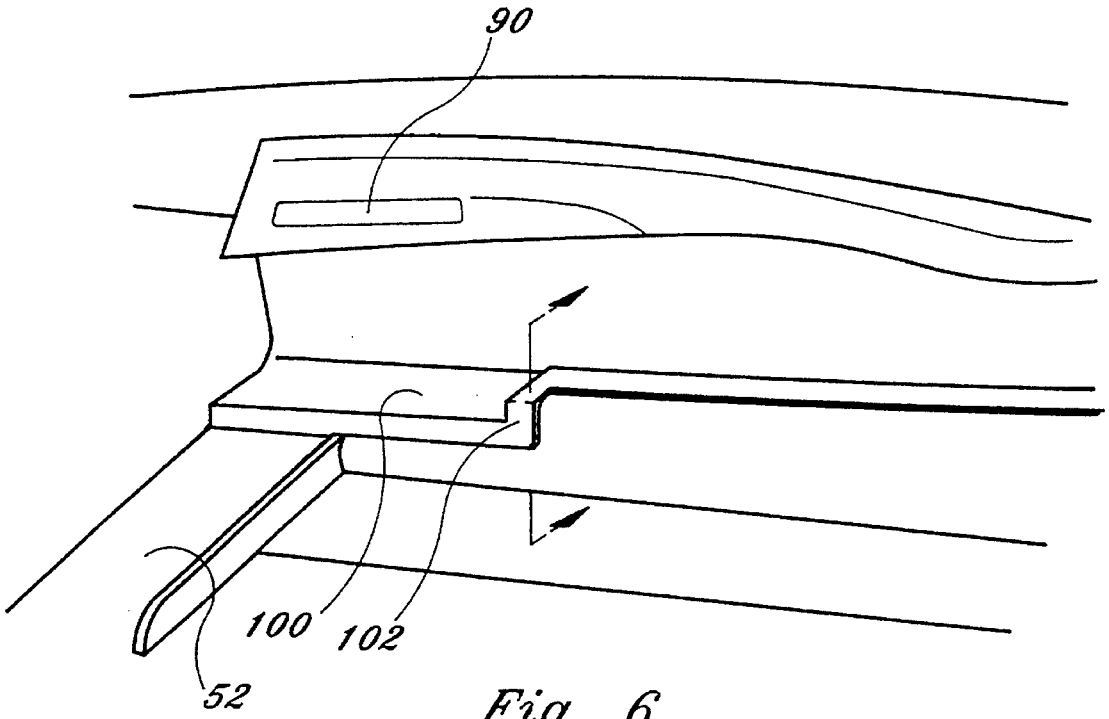
FIG. 6 is a perspective of the side panel adjacent the jump seat of the present invention.
Figure 8:
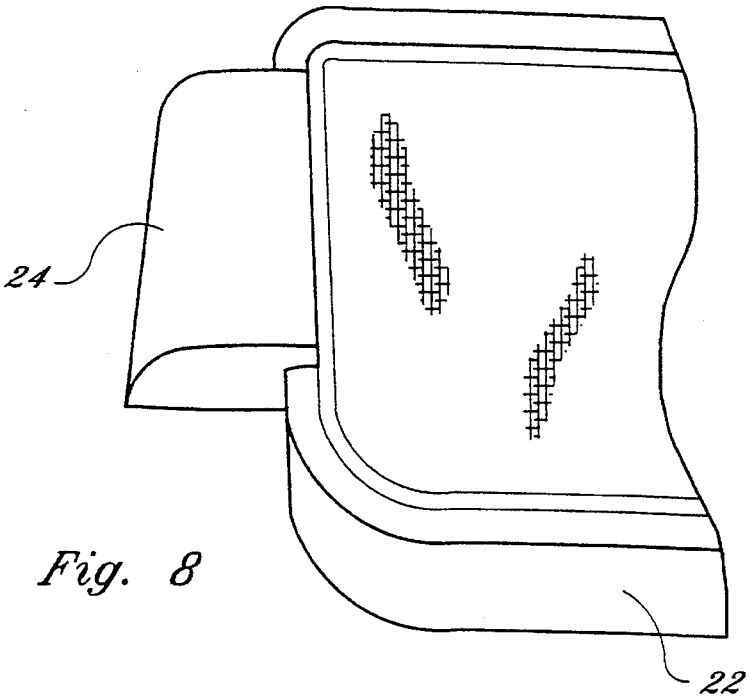
FIG. 8 is a perspective view illustrating the lip member of the cushion portion of the jump seat of the present invention.

As seen in FIG. 6, a dedicated cavity/retainer 90 is provided in the side of the boat which the seat portion 22 can lock into, creating a very stable positioning of the seat, when the seat portion 22 is in its high position acting as part of sunpad 40. Thus a person can stand on the center or on the edge of the locked seat portion 22 and it will not topple. To lock the seat member 22, as seen in FIG. 3, the seat portion 22 is provided a lip member 24 (FIG. 8) that protrudes out of the side of the seat portion 22 and fits in the dedicated cavity 90 disposed in the side panel. The other end of seat portion 22 rest on a ledge member 91 of motor box 95 which is part of an upper half assembly 250. Once locked, forward movement of seat portion 22 is prevented.

The dedicated cavity 90 can be an orifice that the lip member 24 will slip into. As stated above, once locked the seat portion 22 is virtually immovable in its sundeck or sunpad position.

Figure 7:
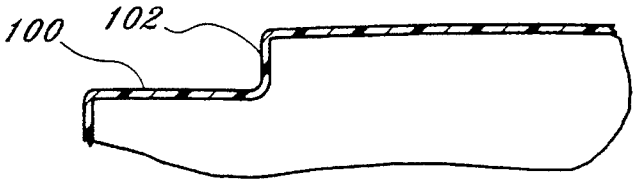
FIG. 7 is an enlarged cutaway view of section A—A of FIG. 8 illustrating the jog member disposed in the side panel.

When the High/Low jump seat 20 is in its lower position acting as a single person seat, the seat member 22 is also stabilized by the positioning of the seat member on a ledge member 93 and the side shelf 100. As seen in FIG. 7, a jog or stud member 102 is provided in the lower side panel which prevents the seat member 22, in the low position, from slipping or moving forward. Thus, the jog member 102 in conjunction with the back of boat 15, prevents forward movement of seat member 22. Seat member 22 fits on the inboard side along ledge 93 and against the fiberglass motor cowl and on the outward side against the hull side to prevent side-to-side movement.

Figure 9:
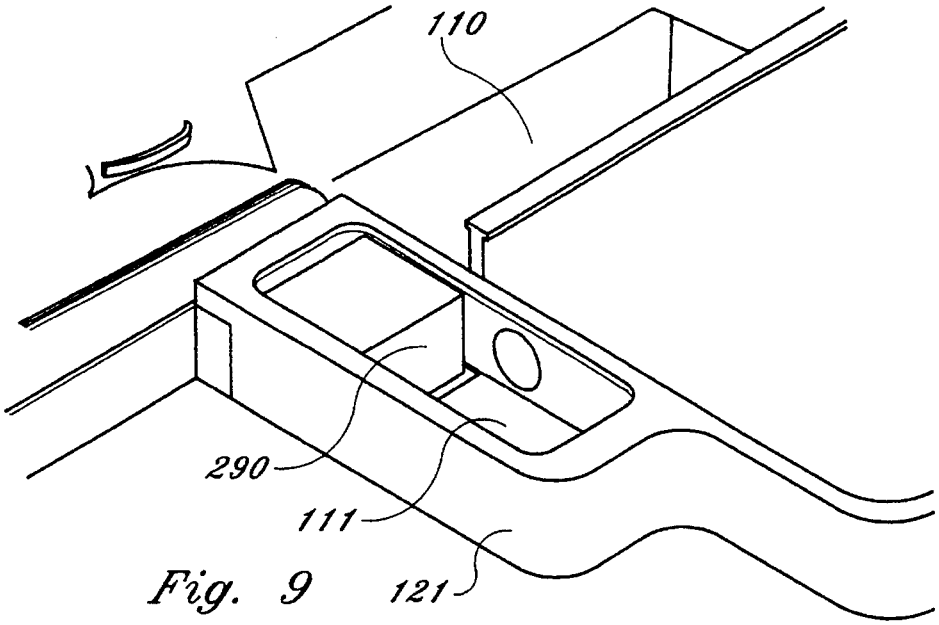
FIG. 9 is a perspective view of the battery switch panel, storage bin and partial storage area of the present invention.

As seen in FIG. 9, the novel aft seating of the present invention allows for storage in a large cavity 110 to the starboard side, as well as storage space 111 which is typically provided underneath the bench seat. Thus, a large area 110 for storage is provided for storing things such as paddles, life preservers, dive equipment, table that comes with the cockpit layout, etc.

As seen in FIG. 1, between the starboard bench seat and the bucket seat, an optional table 120 may be provided. The design of this table allows bucket seat 70 to spin around and access the table 120 as well as the people sitting in the aft bench seat 10. With table 120 set up, there still is room to move from the forward end of boat 15 to the aft end of the boat without table 120 interfering with the passageway.

The major structural components for the unique aft seating of the present invention consist of two main fiberglass parts, a lower fiberglass or aft seat base 200 which incorporates the bottom half of the motor enclosure, including the dedicated step 52 and the bench seat base portion 121, and an upper hatch or sunpad hatch assembly 250. Thus, there are basically, two main fiberglass parts that make up the aft seating. Lower half assembly 200 has molded into this one piece bench seat base 121, boarding step 52 on the port side of the boat, as well as the lower half of the engine cowl or motor box 95.

Figure 12:
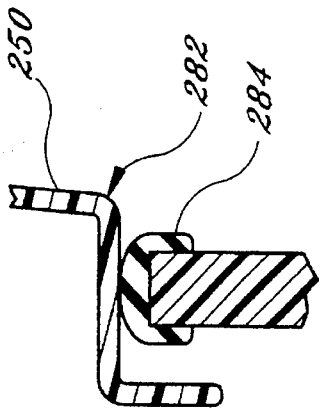
FIG. 12 is a sectional view taken along the lines A—A of FIG. 11 illustrating the bulb seal relationship between the lower hatch assembly and the upper hatch assembly.

The upper half or upper hatch assembly 250 is hinged across its aft end and is raised with an electric hatch actuator 262 to gain access into the bilge, storage area 110 and the motor or engine 291. An overlapping lip 280 (FIG. 11) is formed when the upper hatch 250 is closed and rests on the lower half 200, a bulb seal is used to create a very tight fit between the upper and lower halves to give a quieter DB level in the cockpit. This bulb seal can be seen in FIG. 12 at reference numeral 284. Thus, the upper hatch assembly 250 comes down and seals on the black bulb at 284, which is a rod-like member disposed around the upper edge of a portion lower half assembly 200. As seen in FIG. 9, a removable rotocast storage bin 290 is shown disposed in first storage area 111 below aft bench seat 10. Offsets are tooled into the upper half of the hatch 250 to provide it with a good sealing surface.

Figure 10:
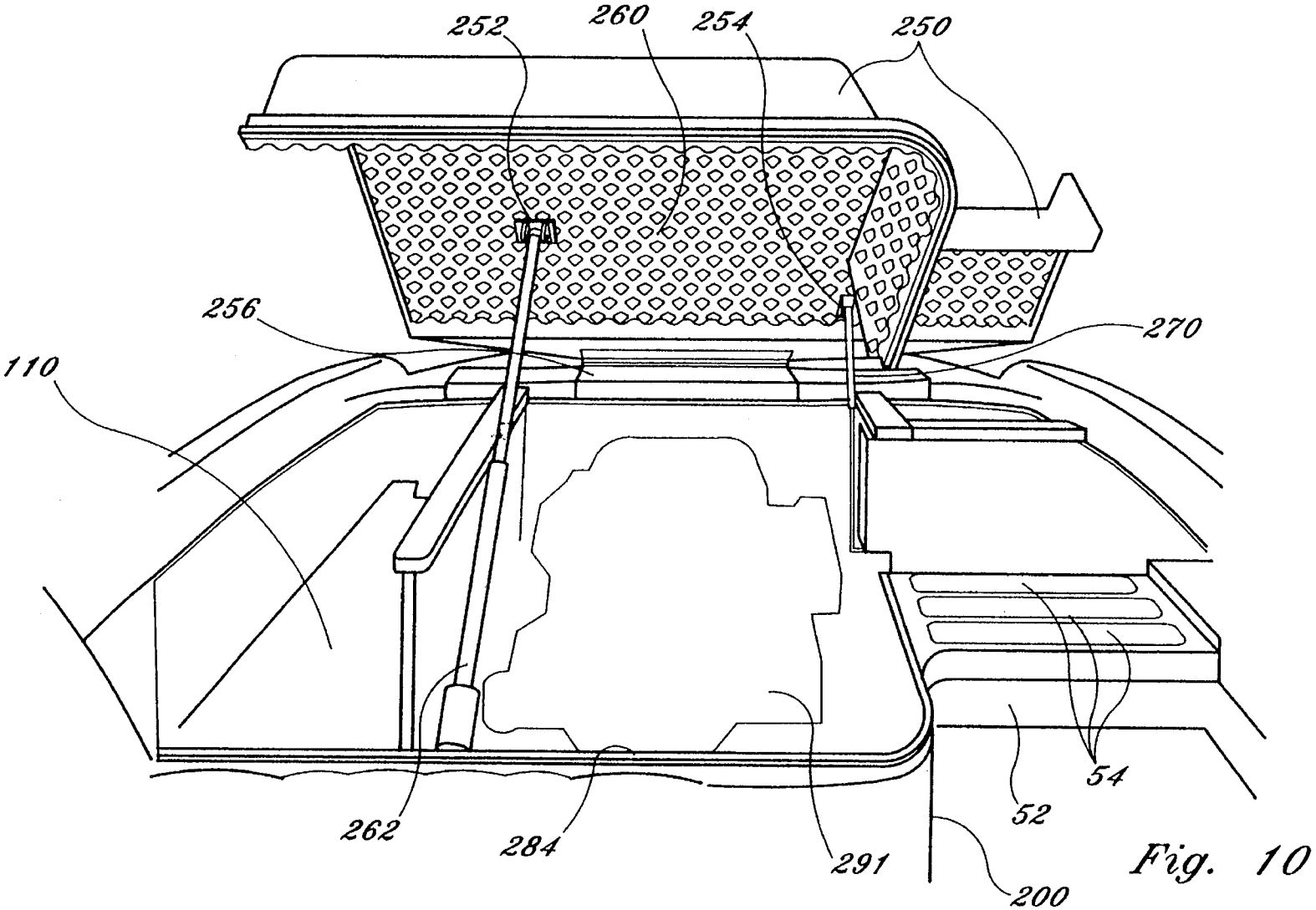
FIG. 10 is a perspective view of the partial storage area, engine and ingress/egress area of the present invention.

As seen in FIG. 10, an electric and telescoping hatch actuator 262 is provided, which operates like a screw jack inside the upper hatch assembly 250. A gas strut 270 towards the port side of the engine is also provided. The gas strut 270 acts as a stabilizer so when upper hatch assembly 250 is open, it doesn't flop around. Gas strut 270 also assists in the consistent lifting of the motor box so it doesn't deform over time.

FIG. 10 also illustrates the underside of upper hatch assembly 250 which shows an electric actuator and a gas strut bracket, 252 and 254, respectively. Also illustrated is the stainless steel hinge 256 across the back which allows the hatch to hinge open and closed off the aft deck cowling. Also seen is that the entire inside of upper hatch assembly 250 is insulated with convoluted foam 260.

Figure 11:
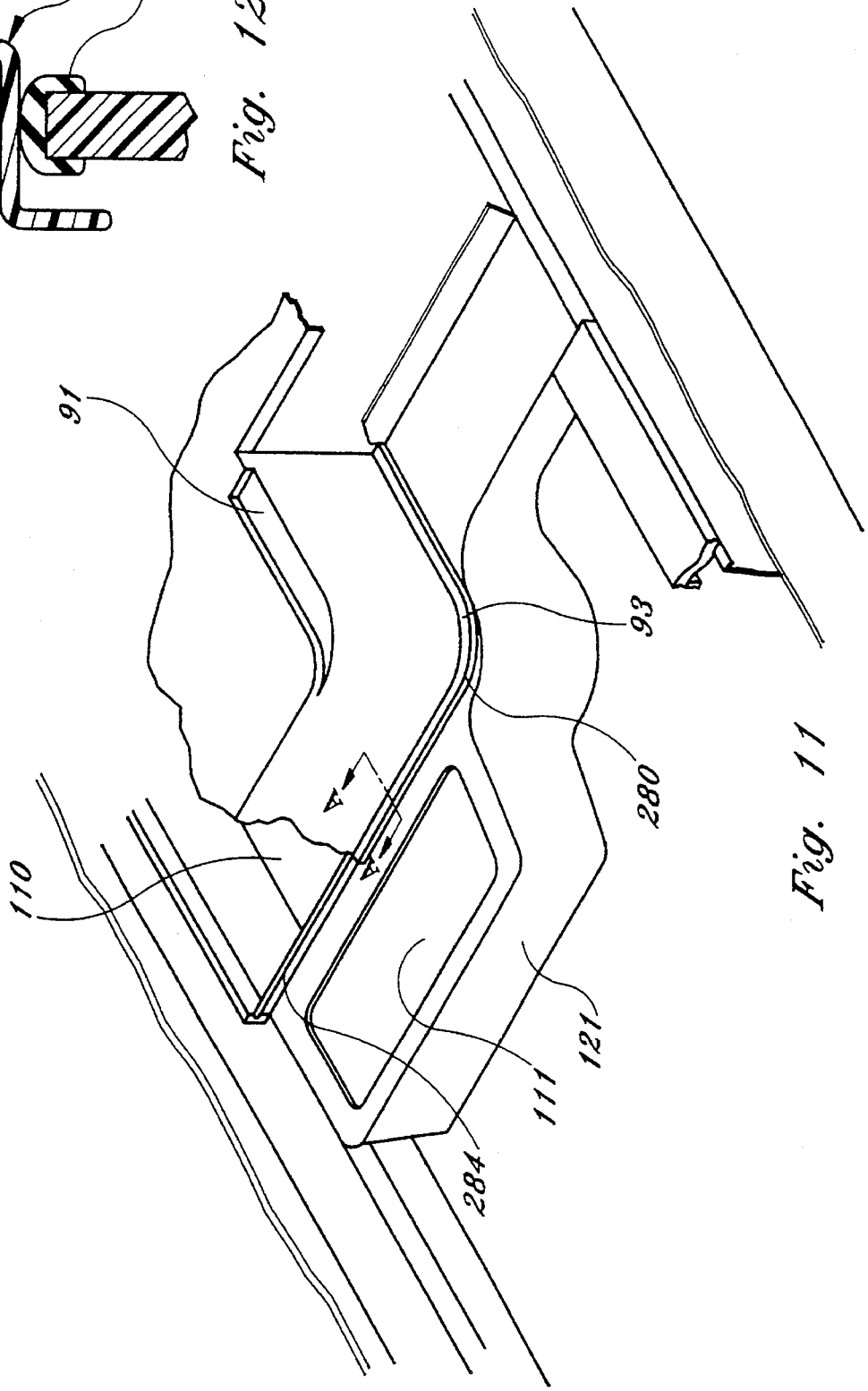
FIG. 11 is a perspective view of the lower hatch assembly and the upper hatch assembly.

FIG. 11 illustrates the basic overview of the installation of the two main fiberglass components and the alignment to each other.

FIG. 1 further illustrates the aft bench seat and jump seat cushion installation showing the position of the cushions creating the aft bench seat 10, the jump seat 20, and the back rests with these associated areas.

The upholstery is applied to the outside by traditional upholstery techniques where foam and vinyl are wrapped over pieces of board. The upholstered parts use a normal cut and sew upholstery techniques where it's wrapped and stapled on the back side of the boards and then the boards are bolted to the fiberglass parts.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination aft seating arrangement, storage units and aft vessel design, comprising:

sunpad means for providing an area for at least one person to lie;

bench means for providing a sitting area for at least one person, said bench means operatively associated with said sunpad means and disposed in front of said sundeck means; and movable means for providing a single person seat in a low position, said movable means operatively associated with said sunpad means in a high position to provide an extended lying area for a plurality of people.

2. The combination aft seating arrangement of claim 1, wherein said movable means can be removed to define a ingress/egress area.

3. The combination aft seating arrangement of claim 2, further including step means disposed within said ingress/egress area to aid in entering and exiting said area.

4. The combination aft seating arrangement of claim 1 further including a storage area disposed beneath said bench means.

5. The combination aft seating arrangement of claim 1 further including a storage area disposed beneath a portion of said sunpad means.

6. A combination aft seating arrangement, storage units and aft vessel design, comprising:

sunpad means for providing an area for at least one person to lie;

bench means for providing a sitting area for at least one person, said bench means operatively associated with said sunpad means and disposed in front of said sunpad means; and movable means for providing a single person seat in a low position, said movable means operatively associated with said sunpad means in a high position to provide an extended lying area for a plurality of people; and means for preventing forward movement of said movable means when said movable means is in a low position.

7. The combination aft seating arrangement of claim 6 wherein said means for preventing is a stud member operatively associated with said vessel, said stud member abutting said movable means in said low position to prevent forward movement of said movable means.

8. A combination aft seating arrangement, storage units and aft vessel design, comprising:

sunpad means for providing an area for at least one person to lie;

bench means for providing a sitting area for at least one person, said bench means operatively associated with said sunpad means and disposed in front of said sunpad means; and movable means for providing a single person seat in a low position, said movable means operatively associated with said sunpad means in a high position to provide an extended lying area for a plurality of people; and means for locking said movable means in said high position.

9. The combination aft seating arrangement of claim 8 wherein said means for locking comprises a lip member operatively associated with said movable means and a cavity disposed on an inner surface of a side wall of said vessel, said lip member disposed within said cavity when said movable means is in said high position to lock said movable means in said high position.

10. A combination aft seating arrangement, storage units and aft vessel design, comprising:

sunpad means for providing an area for at least one person to lie;

bench means for providing a sitting area for at least one person, said bench means operatively associated with said sunpad means and disposed in front of said sunpad means; and movable means for providing a single person seat in a low position, said movable means operatively associated with said sunpad means in a high position to provide an extended lying area for a plurality of people; said movable means can be removed to define a ingress/egress area;

step means disposed within said ingress/egress area to aid in entering and exiting said area; and means for preventing slipping or skidding disposed on a top surface of said step means.

11. A combination aft seating arrangement, storage units and aft vessel design, comprising:

sunpad means for providing an area for at least one person to lie;

bench means for providing a sitting area for a plurality of people, said bench means operatively associated with said sunpad means and disposed in front of said sunpad means; and a movable seat member which can be disposed in either a low position to form a single person seat, a high position to be operatively associated with said sunpad means to provide an extended lying area for a plurality of people, or removed to define a ingress/egress area.

12. The combination aft seating arrangement of claim 11, further including step means disposed within said ingress/egress area to aid in entering and exiting said area.

13. A combination aft seating arrangement, storage units and aft vessel design, comprising:

sunpad means for providing an area for at least one person to lie;

bench means for providing a sitting area for a plurality of people, said bench means operatively associated with said sunpad means and disposed in front of said sunpad means;

a movable seat member which can be disposed in either a low position to form a single person seat, a high position to be operatively associated with said sunpad means to provide an extended lying area for a plurality of people, or removed to define a ingress/egress area; and a first storage area disposed beneath said bench means and a second storage area disposed beneath a portion of said sunpad means.

14. A combination aft seating arrangement, storage units and aft vessel design, comprising:

sunpad means for providing an area for at least one person to lie;

bench means for providing a sitting area for a plurality of people, said bench means operatively associated with said sunpad means and disposed in front of said sunpad means;

a movable seat member which can be disposed in either a low position to form a single person seat, a high position to be operatively associated with said sunpad means to provide an extended lying area for a plurality of people, or removed to define a ingress/egress area; and means for preventing forward movement of said movable seat member when said movable seat member is in said low position.

15. The combination aft seating arrangement of claim 14 wherein said means for preventing is a stud member operatively associated with said vessel, said stud member abutting said movable seat member in said low position to prevent forward movement of said movable seat member.

16. A combination aft seating arrangement, storage units and aft vessel design, comprising:

sunpad means for providing an area for at least one person to lie;

bench means for providing a sitting area for a plurality of people, said bench means operatively associated with said sunpad means and disposed in front of said sunpad means;

a movable seat member which can be disposed in either a low position to form a single person seat, a high position to be operatively associated with said sunpad means to provide an extended lying area for a plurality of people, or removed to define a ingress/egress area; and means for locking said movable seat member in said high position.

17. The combination aft seating arrangement of claim 16 wherein said means for locking comprises a lip member operatively associated with said movable seat member and a cavity disposed on an inner surface of a side wall of said vessel, said lip member disposed within said cavity when said movable seat member is in said high position to lock said movable seat member in said high position.

18. A combination aft seating arrangement, storage units and aft vessel design, comprising:

sunpad means for providing an area for at least one person to lie, said sunpad means including a padding member operatively associated with an upper frame assembly;

bench means for providing a sitting area for a plurality of people, said bench means disposed in front of said sunpad means and extending across approximately three-fourths the width of the vessel, said bench means including seat member operatively associated with a portion of a lower frame assembly, said lower frame assembly operatively associated with said upper frame assembly, said lower frame assembly defining a first storage area beneath said bench means and in conjunction with said upper frame assembly defining a second storage area beneath a portion of said sunpad means;

a movable seat member which can be disposed in either a low position to form a single person seat, a high position to be operatively associated with said sunpad means to provide an extended lying area for a plurality of people extending across nearly the entire width of the vessel, or removed to define a ingress/egress area, said lower frame assembly further defining a step means disposed within said ingress/egress area, said step means having either a non-skid top surface or a plurality of treads disposed on its top surface;

means for preventing forward movement of said movable seat member when said movable seat member is in said low position; and means for locking said movable seat member in said high position.

19. The combination aft seating arrangement of claim 18 wherein said means for preventing is a stud member operatively associated with said vessel, said stud member abutting said movable seat member in said low position to prevent forward movement of said movable seat member.

20. The combination aft seating arrangement of claim 18 wherein said means for locking comprises a lip member operatively associated with said movable seat member and a cavity disposed on an inner surface of a side wall of said vessel, said lip member disposed within said cavity when said movable seat member is in said high position to lock said movable seat member in said high position.

* * * * *